United States Patent [19]

Johnson

[11] 4,062,069

[45] Dec. 13, 1977

[54] BACKREST FOR BEDPANS

[76] Inventor: Phyllis Johnson, 189-12 Mangin Ave., Queens, N.Y. 11412

[21] Appl. No.: 685,403

[22] Filed: May 11, 1976

[51] Int. Cl.[2] ..... A47K 17/00; A61G 9/00

[52] U.S. Cl. ..... 4/1; 4/112; 4/113; 4/185 HB

[58] Field of Search ..... 4/185 HB, 112, 113, 4/1, 185 R

[56] References Cited

U.S. PATENT DOCUMENTS

| | | | |
|---|---|---|---|
| 1,954,684 | 4/1934 | Shively | 4/112 |
| 2,200,247 | 5/1940 | Haas | 4/185 HB |
| 2,523,452 | 9/1950 | Shively | 4/112 X |
| 2,732,563 | 1/1956 | Shively | 4/112 |
| 3,078,474 | 2/1963 | Chartlen | 4/185 HB |
| 3,484,874 | 12/1969 | Bickanhausar, Jr. | 4/112 |

*Primary Examiner*—Henry K. Artis
*Attorney, Agent, or Firm*—Robert D. Farkas

[57] ABSTRACT

A backrest which is removably affixable to bedpans comprising a rigid padded plate, and affixing means for removably affixing the rigid padded plate adjacent to the rear portion of the bedpan, the rigid padded plate serving as a backrest which supports the user in a comfortable position.

2 Claims, 2 Drawing Figures

BACKREST FOR BEDPANS

BACKGROUND OF THE INVENTION

1. Field of the Invention

The present invention relates to accessories for bedpans, and more particularly, to a backrest adapted to be removably affixed to a bedpan.

2. Description of the Prior Art

Bedpans are primarily used for patients who are, for various reasons, bedridden and possible weak. Several bedpans have been proposed in the prior art which have been contoured in various manners to improve user comfort. However, as the users of bedpans are usually relatively weak much difficulty is incurred in sitting once upon the bedpan. Frequently a nurse of other personnel must attend and hold a patient while on a bedpan. The present invention provides a backrest which is easily and quickly removably affixed to a bedpan and providing a surface adjacent to the user's back for support in a sitting position without outside assistance.

SUMMARY OF THE INVENTION

Therefore, it is a primary object of the present invention to provide a backrest for bedpans which supports the user in a comfortable sitting position without outside assistance.

A further object is to provide a backrest which is quickly and easily attached and removed to various types, sizes and shapes of bedpans.

Another object is to provide a backrest for bedpans which is simple in design, inexpensive to manufacture, and durable.

These objects, as well as further objects and advantages of the present invention will become readily apparent after reading the description of a non-limiting illustrative embodiment and the accompanying drawing.

The present invention provides a backrest for bedpans which will permit the user thereof to assume a comfortable sitting position with minimal effort and without assisting personnel. A rigid plate which is padded is removably affixed adjacent to the rear portion of a conventional bedpan and serves as a backrest. The rigid plate forms an obtuse angle with a plane passing through the uppermost surface of the bedpan. The rigid plate is affixed to the bedpan by a pair of substantially L-shaped brackets, each fixedly secured on a free end thereof to opposite sides of the plate, the other ends of each of said L-shaped brackets engaging the lowermost surface of the bedpan. A spring bias urged securing strap is affixed on each end thereof to one of the L-shaped brackets and circumscribes the front and side walls of the bedpan thereby securing the rigid plate in position. After use the backrest may be quickly and easily disengaged from the bedpan by removal of the strap.

BRIEF DESCRIPTION OF THE DRAWINGS

In the order that the present invention may be more fully understood it will now be described, by way of example, with reference to the accompanying drawings in which.

DESCRIPTION OF THE PREFERRED EMBODIMENT

Figure 1:
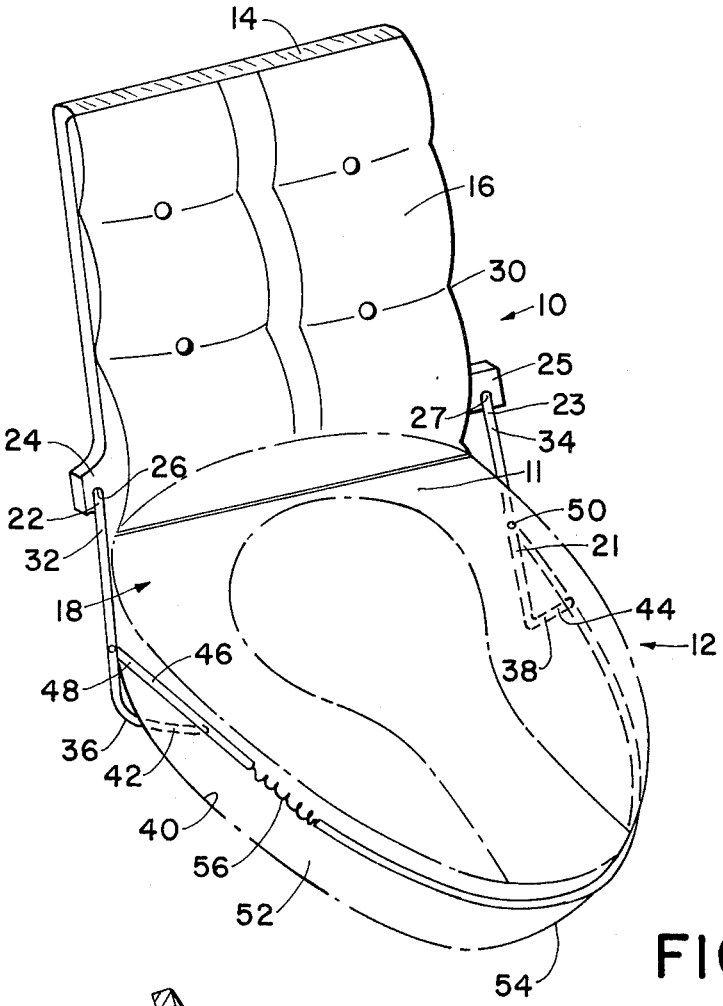
FIG. 1 is a perspective view of the preferred embodiment of the present invention attached to a conventional bedpan.

Referring now to the drawings, and more particularly to FIG. 1, there is illustrated therein a backrest 10 removably affixed adjacent to the rear portion 11 of a bedpan 12. The backrest 10 provides a rigid plate 14 having padding 16 fixedly secured thereto. The padding 16 preferably is polyurethane covered with vinyl although other suitable materials may be used. The rigid plate 14 is shown as a rectangular shape but may be provided with contoured surfaces for greater user comfort.

Figure 2:
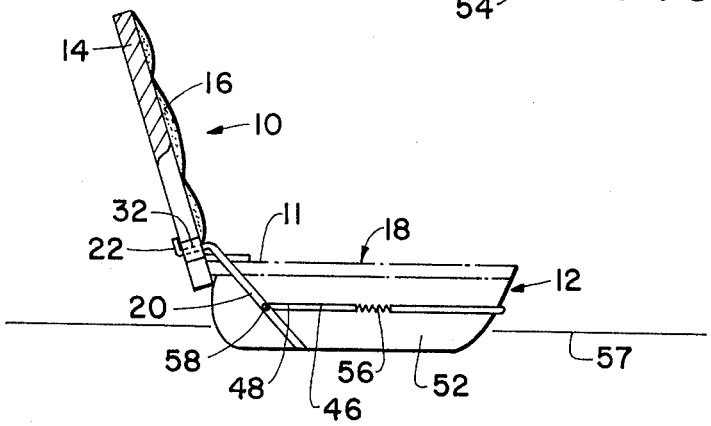
FIG. 2 is a side view of the preferred embodiment attached to a conventional bedpan.

The rigid plate 14 rests on the uppermost surface 18 of the bedpan 12 and is removably affixed to the bedpan 12 at an obtuse angle formed by the rigid plate 14 and an imaginary plane passing through the uppermost surface 18 of the bedpan 12. A pair of substantially L-shaped brackets 20 and 21 are each affixed on the free ends 22 and 23 to a pair of tabs 24 and 25 having apertures 26 and 27 therein, the tabs 24 and 25 being provided on opposed sides 28 and 30 of the rigid plate 14. Portions 32 and 34 adjacent the free ends 22 and 23 of the L-shaped brackets 20 and 21 pass through the apertures 26 and 27 and are bent to prevent removal therefrom as shown in FIG. 2. The portions 32 and 34 may journal with the apertures 26 and 27 to permit the L-shaped brackets 20 and 21 to be folded when the backrest 10 is not in use. The other free ends 36 and 38 of each of the L-shaped brackets 20 and 21 extend under and engage the lowermost surface 40 of the bedpan 12. The sections 42 and 44 adjacent the other free ends 36 and 38 preferably provide flat parallel uppermost and lowermost surfaces and may be covered with rubber or the like to prevent slippage against the lowermost surface 40.

A securing strap 46 is affixed on one free end 48 thereof to the L-shaped bracket 20 and on the other free end 50 thereof to the L-shaped bracket 21. The securing strap 46 circumscribes the side walls 52 and the front walls 54 of the bedpan 12 and is tensioned by a coil spring 56. The coil spring 56 also permits adjustment of the length of the securing strap 46 thereby permitting the accommodation of various sized and shaped bedpans.

The securing strap 46 may be constructed of rubber backed nylon webbing or the like.

FIG. 2 illustrates the backrest 10 removably affixed to the bedpan 12 which is resting on a mattress 57. The securing strap 46 is pivotally affixed on the end 48 thereof by a pivot 58 to the L-shaped bracket 20. The other end 50, not shown, of the securing strap 46 is similarly affixed to the L-shaped bracket 21 by a pivot 60, not shown. The pivots 58 and 60 permit the angle of the securing strap 46 relative to the L-shaped brackets 20 and 21 to be adjusted to accommodate differently contoured bedpans.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A backrest for bedpans comprising a rigid plate, affixing means for removably affixing said plate adjacent the rear portion of a bedpan, said plate thereby serving as a backrest when said bedpan is used in an independent horizontal supporting surface, said affixing means comprises a pair of substantially L-shaped brackets, each fixedly secured on a free end thereof to opposed sides of said plate, the other free ends of each of said substantially L-shaped brackets engaging the lowermost surface of said bedpan, a securing strap affixed on each end thereof to one of said L-shaped brackets adjacent the bend of said brackets, securing strap circumscribing the side and front walls of said bedpan.

2. The backrest for bedpans as claimed in claim 1, wherein each of the free ends of said substantially L-shaped brackets affixed to said plate are inserted into a tab having an aperture therein located on said opposed sides of said plate, said L-shaped brackets passing through said aperture and bent to prevent the removal therefrom.

* * * * *